US005167359A

United States Patent [19]

Frommelt

[11] Patent Number: 5,167,359

[45] Date of Patent: Dec. 1, 1992

[54] SETTING DEVICE FOR FASTENING ELEMENTS

[75] Inventor: Markus Frommelt, Fürstentum, Liechtenstein

[73] Assignee: Hilti Aktiengesellschaft, Furstentum, Liechtenstein

[21] Appl. No.: 769,291

[22] Filed: Oct. 1, 1991

[30] Foreign Application Priority Data

Oct. 11, 1990 [DE] Fed. Rep. of Germany ..... 4032200

[51] Int. Cl.[5] ..... B25C 1/04

[52] U.S. Cl. ..... 227/8

[58] Field of Search ..... 227/8

[56] References Cited

U.S. PATENT DOCUMENTS

| | | | |
|---|---|---|---|
| 3,563,438 | 2/1971 | Doyle et al. | 227/8 |
| 3,606,128 | 9/1971 | Last et al. | 227/8 |
| 3,615,049 | 10/1971 | Obergfell et al. | 227/8 |
| 3,858,781 | 1/1975 | Obergfell et al. | 227/8 |
| 3,893,610 | 7/1975 | Smith | 227/8 |
| 4,197,974 | 4/1980 | Morton et al. | 227/8 |
| 4,470,531 | 9/1984 | Anstett | 227/8 |
| 5,020,712 | 6/1991 | Monacelli | 227/8 |

*Primary Examiner*—Frank T. Yost
*Assistant Examiner*—Scott A. Smith
*Attorney, Agent, or Firm*—Anderson Kill Olick & Oshinsky

[57] ABSTRACT

A portable setting device for driving fastening elements (4) through a structural member (B) has a muzzle part (1) mounted on and extending outwardly from a housing (2). The muzzle part (1) has a receiving region (5*a*) in a barrel (5) for a fastening element (4) in position ready to be driven. A feeler (47) is positioned on and extends in the driving direction outwardly from a leading end of the muzzle part (1). When the leading end of the feeler (47) is displaced rearwardly flush with the leading end of the muzzle part (1) the fastening element driving operation can be carried out. A pivotally mounted locking lever (50) is arranged to block the rearward displacement of the feeler (47) when there is not a fastening element (4) in the receiving region (5*a*). Accordingly, the setting device can not be operated unless a fastening element (4) is present in the receiving region (5*a*).

2 Claims, 2 Drawing Sheets

SETTING DEVICE FOR FASTENING ELEMENTS

BACKGROUND OF THE INVENTION

The present invention is directed to a portable setting device for driving fastening elements into a receiving material. The device includes a housing with a muzzle part mounted on and projecting outwardly from it. The muzzle part has an axially extending barrel arranged to be pressed against the receiving material. A region within the barrel is arranged to receive a fastening element positioned to be driven into the receiving material. A feeler is displaceably mounted in the muzzle part and has a leading end located outwardly from the leading end of the muzzle part in a first position and is displaceable into a second position, flush with the leading end of the muzzle part, so that the fastening element can be driven.

Such a setting device is known in general and has a receiving region for a fastening element in position to be driven into a structural member. In addition, it has a muzzle part and a feeler projecting outwardly from the leading end of the muzzle part. When the feeler is displaced into a position flush with the leading end of the muzzle part, a fastening element can be driven by the setting device. This setting device can be triggered even when there is no fastening element in the receiving region.

SUMMARY OF THE INVENTION

Therefore, the primary object of the present invention is to provide a setting device of the above described type which ensures that the device can not be operated unless there is a fastening element in the receiving region.

In accordance with the present invention, a pivotally mounted locking lever is provided in the setting device for blocking rearward displacement of the feeler when no fastening element is in the receiving region.

The feeler can be displaced rearwardly into the setting device opposite to the driving direction of the device against a spring force. The feeler projects axially from the setting device to the maximum extent in the rest position of the device and extends axially outwardly from the leading end of the muzzle part. If there is no fastening element in the receiving region, the feeler is blocked by the locking lever, so that it can not be displaced rearwardly opposite to the driving direction into the setting device, when the device is pressed against a structural member. As a result, it is not possible to initiate the driving operation, whereby the person operating the device can immediately note that the device does not have a fastening element in position to be driven.

In an advantageous embodiment of the invention, the locking lever can be pivoted around an axis extending in the driving direction with the lever having a part at one end for checking the loaded condition of the device and a part for blocking the feeler when there is no fastening element in the receiving region.

Accordingly, if the part checking the receiving region finds there is no fastening element, the opposite part of the locking lever drops simultaneously into a transverse groove in the feeler, so that the feeler pin can not be displaced in its axial direction. The checking part of the locking lever is pressed out of the receiving region only when a fastening element is pushed into the receiving region, whereby the locking portion is lifted out of the groove. With the feeler released, it can be displaced rearwardly when the setting device is pressed against the surface of a structural material, whereby the leading end of the feeler is moved into a position flush with the leading end of the muzzle part. In this condition the driving of a fastening element into the structural member can be triggered.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

The setting device of the present invention is used for driving fastening elements, such as nails, bolts and the like, into a receiving material, such as wood, steel, concrete and the like.

Figure 1:
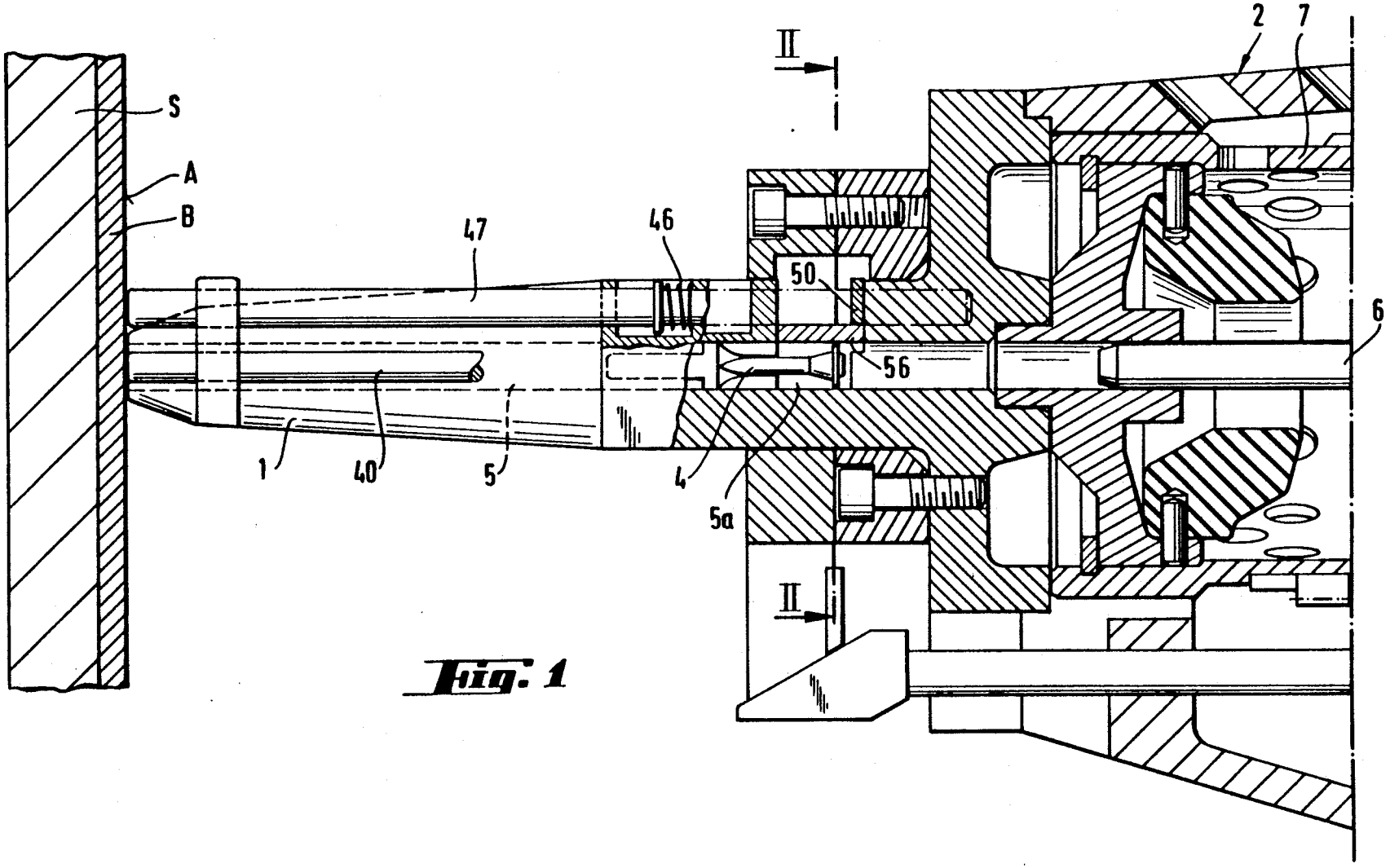
FIG. 1 is an axially extending sectional view of the leading end of a setting device embodying the present invention and taken along the line I—I.

In FIG. 1 the leading end of the setting device is shown, and the device includes a housing 2 with a muzzle part 1 mounted on the leading end of the housing and extending axially outwardly from it. As shown in FIG. 1, the leading end of the muzzle part 1 bears against a surface A of a structural member B for driving a fastening element 4 through the structural member. As illustrated, the fastening element 4 is a nail located within a barrel 5 of the muzzle part 1 and the nail is located in a receiving region 5*a* ready to be driven into the structural member. The trailing or head end of the fastening element 4 is driven by a hammer 6 securely connected with a piston, not shown, guided in a guide cylinder 7 of the housing 2. In the arrangement shown in FIG. 1, the surface A is a surface of a piece of sheet metal B forming the structural member to be attached to a steel girder S. Accordingly, the fastening element 4 is driven through the piece of sheet metal B into the steel girder S. The head of the fastening element 4, when driven, bears against the surface A of the sheet metal B and presses the sheet metal against the steel girder S.

Figure 2:
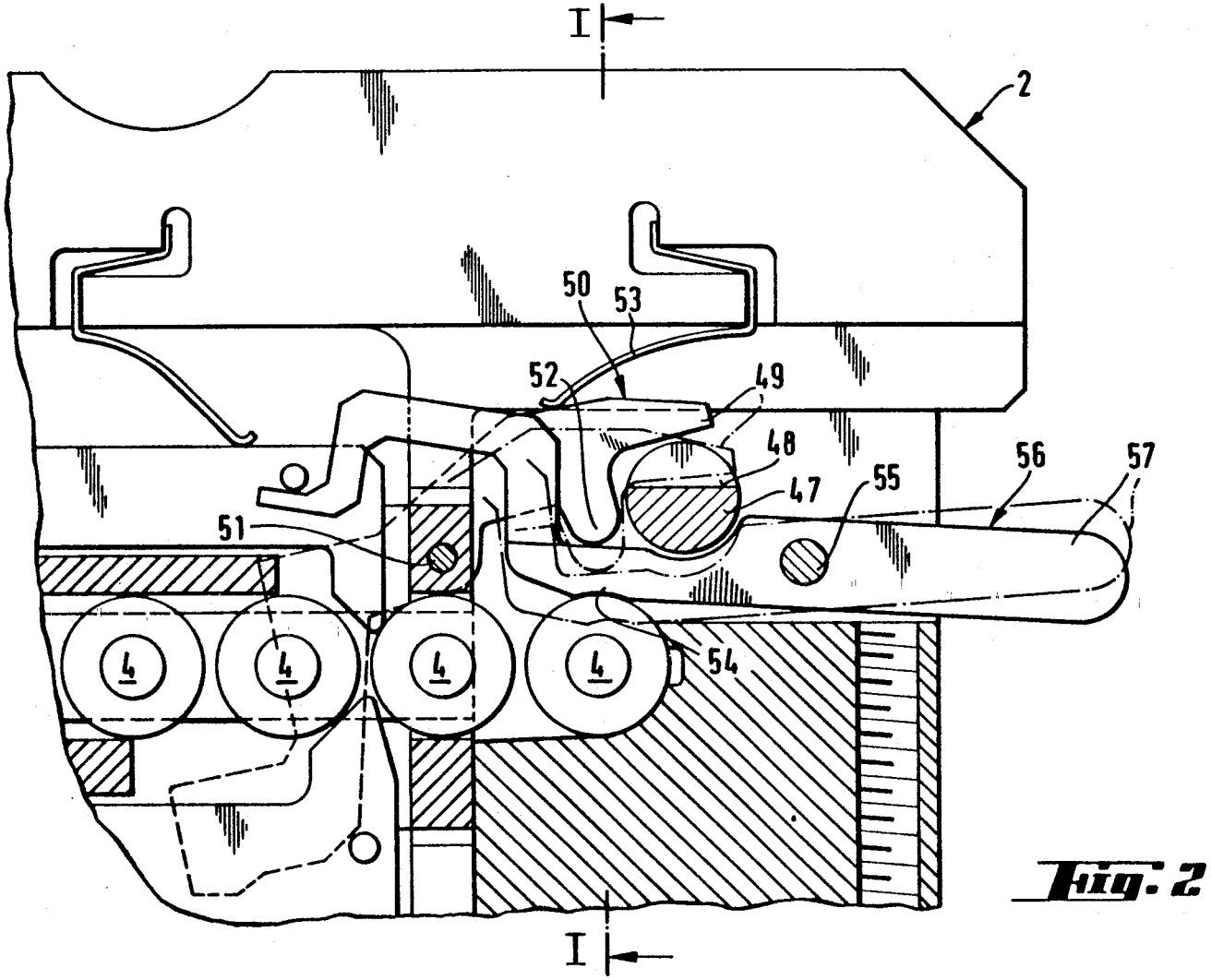
FIG. 2 is a sectional view of the setting device taken along the line II—II in FIG. 1.

As can be seen in FIG. 1, a feeler 47 is displaceably mounted in the muzzle part 1 and is biased through the leading end of the muzzle part by a spring 46. As shown in FIG. 2, the feeler 47 has a transverse groove 48 arranged to receive a locking part 49 of a locking lever 50. Locking lever 50 is pivotally displaceable around an axis 51 parallel to the axis of the barrel 5. In addition, locking lever 50 has a feeler part 52 extending downwardly from the locking part 49, and the feeler part senses whether or not a fastening element 4 is located in the receiving region 5*a* via an unlocking lever 56. The locking lever 50 is biased in the clockwise direction about the axis 51 by a spring 53, note FIG. 2.

The feeler part 52 of the locking lever 50 is biased against an unlocking arm 54 of the unlocking lever 56 which is pivotally displaceable around an axis 55 extending parallel to the axis of the barrel 5. Unlocking arm 54 extends from one side of the axis 55 and another arm 57 extends in the opposite direction from the other side of the axis 55. The arm 57 extends laterally outwardly from the muzzle part 1 and can be actuated by hand. As can be seen in FIG. 2, unlocking arm 54 is positioned so that it is contacted by a fastening element 4 located within the receiving region 5*a*.

If there is not a fastening element 4 in the receiving region 5*a*, the unlocking lever 56 is pivoted around the axis 55 in the counterclockwise direction, so that the unlocking arm 54 of the lever is displaced downwardly into the receiving region, note the showing in phantom in FIG. 2. Due to the action of the spring 53, the feeler part 52 of the locking lever 50 follows the downward movement of the unlocking arm 54, whereby the locking part 49 moves into the transverse groove 48 of the feeler 47. As a result, the feeler 47 can not be displaced opposite to the driving direction into the housing 2 when the setting device is placed against the surface A of the structural member B, so that a locking rod 40 located within the muzzle part and extending parallel with the feeler 47 and projecting axially outwardly from the leading end face of the muzzle part 1, can not be displaced rearwardly into an unlocked position. Accordingly, the setting device can not be actuated.

By comparison, if a fastening element 4 is moved into the receiving region, the unlocking arm 54 of the unlocking lever 56 is contacted by the fastening element, so that unlocking lever 56 pivots, in the clockwise direction, around the axis 55. The unlocking arm 54 moves upwardly lifting the feeler part 52 and pivots the unlocking lever 50 in the counterclockwise direction around the axis 51. Due to this pivotal movement, the locking part 49 is lifted out of the transverse groove 48 in the feeler 47, so that both the feeler 47 and the locking rod 40 can be displaced opposite to the driving direction into the housing 2 when the setting device is pressed against the surface A of the structural member B. The driving of the fastening element can be triggered as soon as the leading end of the feeler 47 and the leading end of the locking rod 40 are flush with the leading end of the muzzle part 1 as is illustrated in FIG. 1.

While specific embodiments of the invention have been shown and described in detail to illustrate the application of the inventive principles, it will be understood that the invention may be embodied otherwise without departing from such principles.

I claim:

1. Portable setting device for driving fastening elements (4) into a receiving material, comprising a housing (2), a muzzle part (1) mounted on and projecting outwardly from a leading end of said housing, said muzzle part (1) has an axially extending barrel (5) therein, said muzzle part has a leading end arranged to be pressed against the receiving material and a trailing end closer to said housing with said leading and trailing ends spaced apart in the axial direction of said barrel, a receiving region (5*a*) in said barrel (5) spaced from the leading end of said muzzle part (1) for receiving a fastening element (4) to be driven into the receiving material, an axially elongated feeler (47) disposed in generally parallel relation with the axis of said barrel and axially displaceably mounted in said muzzle part, said feeler (47) has a first position with a leading end thereof spaced outwardly from the leading end of said barrel and a second position with the leading end thereof flush with the leading of said muzzle part for releasing a driving operation of said setting device, wherein the improvement comprises an elongated locking lever (50) pivotally mounted in said muzzle part (1) and arranged to block displacement of said feeler (47) into the second position when no fastening element is present in the receiving region (5), the locking lever (50) is pivotable about an axis (51) in generally parallel relation with the axis of said barrel (5) and said locking lever has a feeler part (52) for checking the presence of a fastening element in the receiving region (5*a*) and a locking part (49) for blocking displacement of said feeler (47) from the first position to the second position when a fastening element is not present in the receiving region, an unlocking lever (56) is pivotally mounted in said muzzle part and is pivotally displaceable around an axis (55), said unlocking lever (56) has an unlocking arm (54) located between the feeler part (52) of said locking lever (50) and the receiving region (5*a*).

2. Portable setting device, as set forth in claim 1, wherein said locking lever (50) is biased by a spring (53) towards the feeler (47).

* * * * *